United States Patent [19]

Stokes

[11] 4,252,005

[45] Feb. 24, 1981

[54] SYMMETRICAL OPPOSED MOTION BASKET FOR AN ORBITAL CLOTHES WASHER

[75] Inventor: Vijay K. Stokes, Schenectady, N.Y.

[73] Assignee: General Electric Company, Schenectady, N.Y.

[21] Appl. No.: 107,495

[22] Filed: Dec. 26, 1979

[51] Int. Cl.[3] ..... D06F 21/06

[52] U.S. Cl. ..... 68/172

[58] Field of Search ..... 68/147, 148, 152–154, 68/171–174, 232, 233, 155, 156, 142, 144, 146, 23 R; 220/DIG. 28; 366/220, 228, 232, 234, 237, 240

[56] References Cited

U.S. PATENT DOCUMENTS

| | | | |
|---|---|---|---|
| 3,280,604 | 10/1966 | Panker | 68/142 X |
| 3,603,118 | 9/1971 | Brucken et al. | 68/233 |

*Primary Examiner*—Philip R. Coe

*Attorney, Agent, or Firm*—Nathan D. Herkamp; James C. Davis, Jr.; Paul R. Webb, II

[57] ABSTRACT

A symmetrical opposed-motion basket design is provided for an orbital clothes washer. The symmetrical opposed-motion basket is structured to cause clothes in one portion of the basket to tend to move clockwise, while clothes in another portion of the basket tend to move counter-clockwise. The center post and outer wall each have a relatively rough surface and the basket bottom wall has a relatively smooth surface comprising two concentric rings, one of which slopes continuously upwardly from the outer wall and the other of which slopes continuously upwardly from the inner wall to a point of intersection of the two rings. This structure enhances mixing and turbulence within the clothes load during the orbital cycles of the clothes washer.

6 Claims, 6 Drawing Figures

SYMMETRICAL OPPOSED MOTION BASKET FOR AN ORBITAL CLOTHES WASHER

BACKGROUND OF THE INVENTION

This invention relates to a basket for an orbital washer of the type described in U.S. Patent application Ser. No. 39,406, filed May 15, 1979 by John Bochan, assigned to the instant assignee and incorporated herein by reference thereto. One type of basket for an orbital washer is described in my prior U.S. Patent application Ser. No. 98,226, filed Nov. 28, 1979, assigned to the instant assignee and incorporated herein by reference thereto.

An orbital washer as described in the above-cited U.S. Patent application, Ser. No. 39,406, employs a drive system, such as an eccentric gear drive system, which moves the basket in a particular generally horizontal orbital motion during its clothes washing and rinsing cycles. During the spin cycle, the basket is centered and rotated rapidly to remove excess water from the clothes.

As described in the above-cited U.S. Patent application Ser. No. 98,226, motion of clothes inside a basket driven in an orbital path is caused by interaction of the cloth with the basket bottom and side wall. With a circular basket having a bottom slope generally upwardly from the outer cylindrical wall toward the central post, clothes tend to move in a helical path continuously about the circumference of the basket. Energy is transferred from the basket to the clothes by interaction of the clothes with the interior surfaces of the basket, generating turbulent motion and thereby washing of the clothes by contact with the basket and other items of the clothes load. The shapes of the surfaces of the basket which contact the clothes determine the pattern of motion of clothes within the basket during orbiting thereof. A desirable objective of basket design is to expose all portions of the clothes to be washed to contact with the interior surfaces of the basket to optimize washing action. The above-cited U.S. Patent application Ser. No. 98,226 describes an unsymmetrical basket design to achieve turbulence and mixing of clothes within the basket.

SUMMARY OF THE INSTANT INVENTION

An object of the instant invention is to provide a basket for an orbital washer having an interior configuration, which causes clothes disposed within the basket to tend to move in a helical path in one portion of the basket, and to tend to move in a helical path in the second portion of the basket in a generally circumferential direction opposite that of the first helical path. Accordingly, the instant invention includes a basket configuration for an orbital washer having a generally cylindrical outer wall, a generally cylindrical center post and a basket bottom wall including a first annular ring sloping continuously upwardly from said outer wall and a second annular ring sloping continuously upwardly from said center post to a point of intersection with said first annular ring. The inner surface of said outer wall and the outer surface of said center post adjacent said annular rings of said bottom wall have a surface having a high resistance to relative motion of damp cloth in contact with said surface, and each of said annular rings has a surface having a low resistance to relative motion of the same damp cloth in contact therewith relative to that of the surfaces of the center post and the outer wall.

BRIEF DESCRIPTION OF THE DRAWINGS

The features of the invention believed to be novel and unobvious over the prior art are set forth with particularity in the appended claims. The invention itself, however, as to organization, method of operation and advantages thereof, may best be understood by reference to the following description taken in conjunction with the accompanying drawings in which:

DESCRIPTION OF THE PREFERRED EMBODIMENTS

Figure 1:
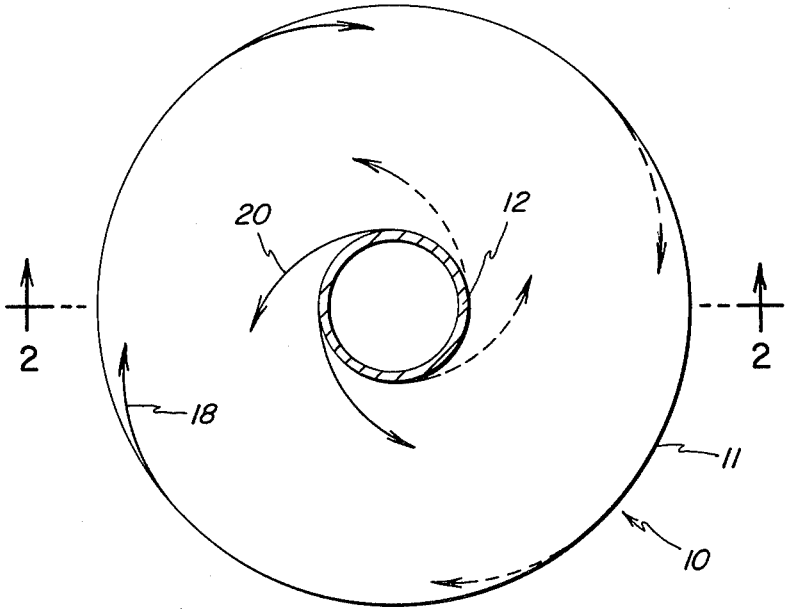
FIG. 1 is a schematic partial cross-sectional top view of a model of a basket for an orbital washer designed according to the instant invention.

The specific features of the instant invention described herein and shown in FIGS. 1–6 are merely exemplary, and the scope of the invention is defined in the appended claims. Throughout the description and FIGS. 1–6, like reference characters refer to like elements of the invention.

Figure 2:
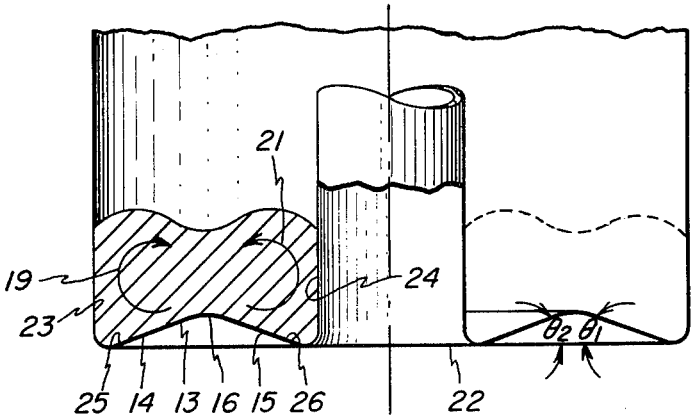
FIG. 2 is a schematic partial cross-sectional view of the model of FIG. 1 taken along line 2—2 thereof.

FIGS. 1 and 2 illustrate a model of a basket for an orbital clothes washer and the action of a clothes load disposed in a basket 10 during orbiting of the basket. The basket 10 comprises cylindrical outer wall 11, center post 12 and bottom wall 13. The bottom wall 13 includes a first generally annular ring 14 which slopes continuously upwardly from the outer wall 11 toward the center post 12, hereinafter called direct slope, and a second generally annular ring 15 which slopes continuously upwardly from the center post 12 toward outer wall 11, hereinafter called reverse slope. The two annular rings 14 and 15 meet to form a curved circle of intersection forming an annular curved peak 16.

If basket 10 is driven such that it moves with a counterclockwise orbit having an angular frequency, $\omega$, and an amplitude, a, clothes disposed within basket 10 and generally between wall 11 and peak 16 will tend to move clockwise as shown by arrow 18 due to interaction of the cloth with the interior surface of outer wall 11 and to turn over in the direction indicated by arrow 19 due to sliding down the slope of annular ring 14 as shown in FIG. 2. The portion of the clothes load disposed in the basket 10 and located generally between post 12 and peak 16 will tend to move counterclockwise as indicated by arrows 20 due to interaction of the clothes with the surface of center post 12 and to turn over as indicated by arrow 21 due to sliding motion of the clothes downwardly along the slope of annular ring 15. The clothes load will tend to be moved with turnaround motion (i.e., motion of cloth in the circumferential direction) in the direction shown by arrows 18 and 20, respectively, for each of the two sloping portions 14 and 15 of the basket bottom. The overall turn-around motion will be a resultant of the combination of these two opposing tendencies, such that one part of the clothes will tend to move in one circumferential direction and the remainder of the clothes will tend to move in the opposite circumferential direction. A reversal of orbit motion causes a reversal in the direction of turn-around in each portion of the basket. For the direct slope portion 14 of basket 10 having a slope $\theta_1$ relative to the horizontal reference line 22, the direction of turn-around motion is always opposite that of the orbit motion, i.e., for a counterclockwise orbit clothes will tend to move clockwise relative to basket 10 as shown by arrows 18. On the other hand, in the reverse slope portion 15 of basket 10 having the slope $\theta_2$ relative to the horizontal reference 22, the turn-around motion is in the same direction as the orbiting motion, i.e., assuming a counterclockwise orbit, the clothes in the reverse slope portion of the basket will tend to move counterclockwise as shown by arrows 20.

The turnover motion always has the same sense, i.e., down along the inclined bottom surface and up the vertical surface adjacent the inclined surface. This sense of motion is not changed by a reversal of the orbiting motion. For fixed values of orbit amplitude a, angular frequency $\omega$ and basket bottom slope, $\theta_1$ or $\theta_2$, the turn-around in each of the direct and reverse slope parts of the basket is facilitated by a rough surface having high resistance to relative sliding motion of fabric in contact therewith on the surface 23 of outer basket wall 11 and the surface 24 of center post 12, respectively. Turnover motion on the inclined bottom surfaces is facilitated, or enhanced, by surfaces 25, 26 which have relatively little resistance to relative sliding motion of damp clothes in contact with the surfaces 25, 26 but which have relatively high resistance to relative sliding motion of damp clothes in contact with sloped surfaces 25, 26 in the upward direction. These principles have been used for producing the symmetrical opposed-motion basket shapes described herein.

In the direct slope portion of the basket, the active or driving wall is the inner surface 23 of the outer wall 11 of the basket, and in the reverse slope portion of the basket, the outer surface 24 of center post 12 is the active or driving wall. This structure provides two driving surfaces with which the clothes impact, so that some portion of the clothes impacts each of the basket driving surfaces at each circumferential position in each orbiting cycle. This improves the washing action, since energy is transferred to the clothes at each impact of the clothes with the driving surfaces. Further, since the two driving surfaces 23, 24 tend to move the clothes in opposite directions, a controlled amount of clothes mixing can be achieved.

In order to reduce tangling of clothes, the turnover motion as illustrated by arrows 19 and 21 in FIG. 2, has to be controlled. This can be achieved, for example, by increasing the turnover motion in either the direct slope or reverse slope portion of the basket by increasing the radial width of one of bottom portions 14 or 15, and reducing turnover motion in the other portion by reducing the radial width of the other of the bottom portions. The degree of turnover motion can be controlled, and possibly even eliminated, by suitably choosing the position of peak 16 relative to the surfaces 23 and 24 and its height relative to reference line 22.

For a given orbit amplitude, a, and orbit frequency, $\omega$, varying amounts of control over clothes motion within the basket can be achieved by suitably choosing (1) the radial position of ring 16, (2) the slopes $\theta_1$ and $\theta_2$ of the annular rings 14 and 15, respectively, (3) the roughness of sidewall surface 23 and the center post surface 24, (4) the roughness of the basket bottom surfaces 25 and 26, and (5) the location and number of drain holes in basket bottom 13.

Figure 3:
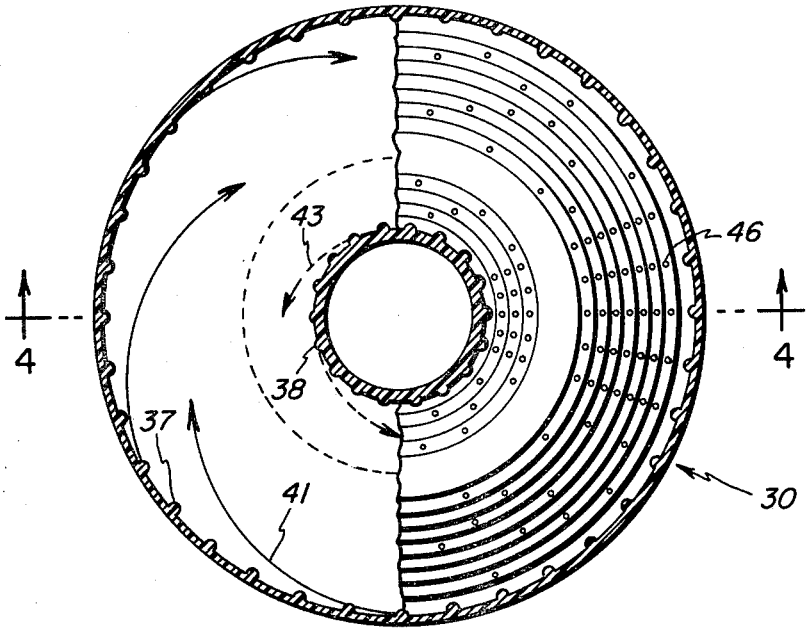
FIG. 3 is a schematic partial cross-sectional top view of a basket for an orbital washer designed according to the instant invention.
Figure 4:
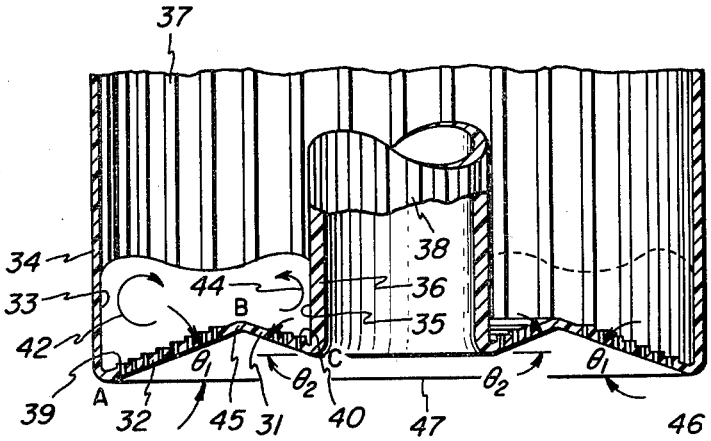
FIG. 4 is a schematic cross-sectional view of the basket of FIG. 3 taken along line 4—4 thereof.

One preferred embodiment of the basket according to my invention is illustrated in FIGS. 3 and 4. The basket 30, made of polymeric material, a metal alloy coated with a polymeric material or porcelain, has a radially-narrower reverse slope bottom portion 31 and a radially larger direct slope portion 32. The two sloping portions 31, 32 have stepped structures as shown in FIGS. 3 and 4. Interior surface 33 of outer basket wall 34 and outer surface 35 of center post 36 have vertical ribs 37, 38, respectively, extending vertically upwardly from the intersection of said inner surface 33 with ring 32 and vertically upwardly from the intersection of said outer surface 35 with ring 31, respectively, to a height above said respective intersections determined to accommodate the maximum expected clothes load. The ribs 37, 38 enhance the roughness of surfaces 33 and 35, respectively, and, thereby, the tendency of clothes to move together with each of surfaces 33, 35, upon impact therewith.

The stepped bottom surfaces 39, 40 provide a smooth surface presenting a low resistance to sliding motion of damp clothes in the tangential direction and in the direction of downward sliding motion of clothes along the bottom slope and a relatively rough surface presenting a high resistance to relative sliding motion of damp cloth in contact with said surface in the direction up the slope, which increases the tendency of the clothes to turn over. The smooth surfaces 39, 40 are shown to be generally horizontal for clarity of the drawings, but are preferably sloped downwardly toward wall 34 and post 36, respectively, so as to further enhance sliding motion in the radially outward and radially inward directions, respectively. In such a basket, clothes would tend to move as indicated by arrows 41, 42, 43 and 44. The net overall result of the combination of tendencies of motion would be a reduction of turnover motion. Due to the position of the peak 45 in the basket bottom, the turnover motion and the turnaround motion in the direct slope portion of the basket above bottom wall ring 32 would tend to dominate, so that overall motion of clothes within the basket would tend to follow the arrows 41, 42, but the velocity of the clothes motion would be reduced due to the tendency of the counteracting motion in the reverse slope portion of the basket above bottom wall ring 31 to move clothes in the direction of arrows 43, 44. Drain holes 46 provide passages for flow-through of water and detergent. The number and spacing of holes 46 would be selected to provide adequate flow and to increase friction of the surfaces 39 and 40 by a limited amount, so that sliding motion of clothes would not be interfered with.

By choosing the radial position of peak 45 relative to post 36 and outer wall 34, the number of steps in each of bottom wall portions 31, 32, the height of each of the steps and the total height of peak 45 above the horizontal reference 47, and thereby the magnitude of slope angles $\theta_1$ and $\theta_2$, the degree of overall clothes motion, both turnover and turnaround, can be selected, for given basket angular frequency, $\omega$, and amplitude, a, and a particular fabric composition of the clothes load.

Each of these factors must be considered in selecting a basket design for a specific orbital washer.

Figure 5:
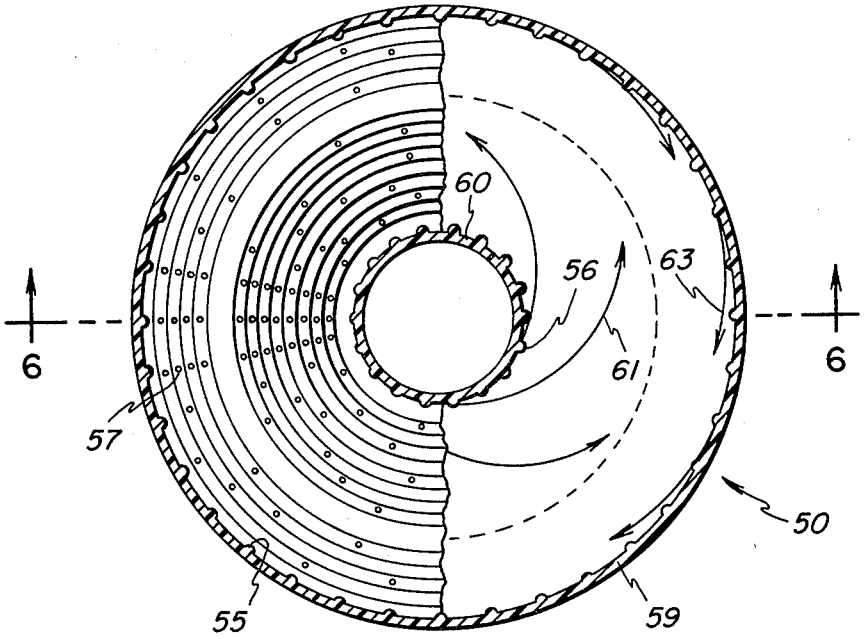
FIG. 5 is a schematic partial cross-sectional top view illustrating an alternate embodiment of a basket for an orbital washer designed according to the instant invention.
Figure 6:
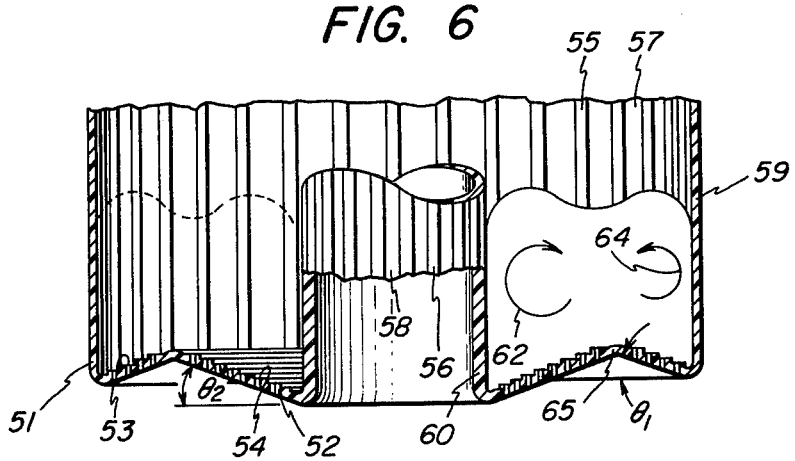
FIG. 6 is a cross-sectional view of the basket of FIG. 5 taken along line 6—6 thereof.

An alternative preferred basket configuration employing the instant invention is shown in FIGS. 5 and 6. The basket 50 has bottom portions 51, 52 of a stepped structure to be selectively rough in the sense that surfaces 53, 54 would appear relatively rough to clothes moving up the slopes and relatively smooth to clothes sliding down the slopes. The step surfaces 53, 54 are shown to be horizontal, but would preferably slope downwardly as described above relative to FIGS. 3 and 4. Further, the surfaces 53, 54 must be smooth in the tangential direction, so as not to interfere with tangential turn-around motion of the clothes. Vertical ribs 55, 56 are provided on the two driving surfaces 57, 58 of outer wall 59 and center post 60, respectively, to increase driving wall roughness at the active surfaces to enhance the tendency toward turn-around motion of the clothes in each of the reverse slope and direct slope portions of basket 50. The drain holes 57 are located in the stepped bottom portions 51 and 52 at spaced locations about the circumference thereof, and their number and location can be selected to contribute a predetermined frictional amount to the overall friction coefficient experienced by clothes moving over the bottom surfaces.

In the basket shown in FIGS. 5 and 6, clothes would tend to have motion as indicated by arrows 61, 62, 63 and 64. The net overall clothes motion resulting from the combination of tendencies of motion would be a reduction of turnover motion. Due to the radial position of peak 65 in the basket bottom relative to center post 60 and outer wall 61, the turnover and the turn-around motion in the reverse slope portion of the basket above bottom wall ring 52 would tend to dominate, so that the overall motion of clothes in basket 50 would tend to follow the arrows 61, 62, but would be reduced in velocity due to the tendency of the counteracting motion in the direct slope portion of the basket above bottom wall ring 51 to move clothes in the direction of arrows 63, 64.

The above-described invention employs a combination of reverse slope and direct slope basket bottom portions to provide the capability of controlling clothes mixing and turbulence within a clothes load in the basket of an orbiting washer. The basket also employs both the center post and the outer wall as energy transfer surfaces to transfer energy from the orbiting basket to the clothes load to facilitate washing of the clothes with detergent and water in a flow-through washing system.

I claim:

1. A basket for an orbital washer comprising an annular outer wall; a basket bottom wall intersecting said outer wall about the circumference thereof; and a generally cylindrical center post projecting upwardly from said bottom wall and being disposed generally concentric with said outer wall; wherein said bottom wall comprises: a first annular ring intersecting said outer wall and sloping continuously upwardly in the radially inward direction from the intersection with said outer wall; and a second annular ring intersecting said center post and sloping continuously upwardly in the radially outward direction from the intersection with said center post to a circumferential peak generally concentric with said outer wall at which said first and second annular rings intersect;

said annular outer wall includes an internal drive surface having over a substantial portion of its height extending vertically upward from the intersection of said outer wall and said first annular ring a high resistance to relative motion of damp cloth in contact therewith;

said center post includes an external drive surface having over a substantial portion of its height extending vertically upward from the intersection of said center post and said second annular ring a high resistance to relative motion of damp cloth in contact therewith; and said first and second annular rings include surfaces having a resistance to relative motion of damp cloth in contact therewith less than the resistance of said surfaces of said outer wall and said center post to relative motion of the same said damp cloth in contact with said outer wall and said center post, respectively.

2. The apparatus of claim 1 wherein said annular outer wall has a plurality of generally vertically-extending ribs attached to the inner surface thereof, and said center post has a plurality of generally vertically-extending ribs attached to the external surface thereof.

3. The apparatus of claim 2 wherein said first annular ring comprises a plurality of generally circumferentially-extending steps having a smooth surface extending generally around the circumference of said first ring, and said second annular ring comprises a plurality of generally circumferentially-extending steps having a smooth surface extending generally around the circumference of said second ring.

4. The apparatus of claim 3 wherein said smooth surfaces of said steps of said first ring slope generally upwardly in the radially inward direction, and said surfaces of said steps of said second ring slope generally upwardly in the radially outward direction; and wherein said steps further comprise drain holes disposed in spaced circumferential locations and passing through the smooth surfaces of the steps of each of said first and second annular rings.

5. The apparatus of claim 4 wherein said first annular ring has a radial dimension greater than said second annular ring.

6. The apparatus of claim 4 wherein said first annular ring has a lesser radial dimension than said second annular ring.

* * * * *